United States Patent [19]

Takahashi et al.

[11] Patent Number: 4,626,820

[45] Date of Patent: Dec. 2, 1986

[54] THERMOSWITCH

[75] Inventors: Tadahiro Takahashi; Shinichi Ohi; Kashiwa Kobayashi, all of Konan, Japan

[73] Assignee: Diesel Kiki Company, Ltd., Tokyo, Japan

[21] Appl. No.: 714,083

[22] Filed: Mar. 20, 1985

[30] Foreign Application Priority Data

Apr. 11, 1984 [JP] Japan ..... 59-52930

[51] Int. Cl.[4] ..... H01H 37/52

[52] U.S. Cl. ..... 337/354; 337/112; 337/380; 174/525

[58] Field of Search ..... 337/354, 380, 381, 113, 337/112; 174/525; 338/164

[56] References Cited

U.S. PATENT DOCUMENTS 2,752,454 6/1956 Kurtz ..... 337/354

4,027,385 6/1977 Deubel ..... 337/112

*Primary Examiner*—Harold Broome

*Attorney, Agent, or Firm*—Wenderoth, Lind and Ponack

[57] ABSTRACT

A thermoswitch in which two fixed terminals are provided to a base disposed in a bottomed housing and a movable contact mechanism is provided between the two fixed terminals so that the movable contact is connected or disconnected by the displacement of a thermosensitive member such as bimetal, wherein the basal portions of the fixed terminals projecting from the base after solidifed with a first resin and a recess formed by the housing and base is filled and solidified with a second resin such that lead wires connected to the fixed terminals are embedded in the resin. According to this device, penetration of water coming down along the lead wires is positively prevented by the two resin layers.

1 Claim, 2 Drawing Figures

THERMOSWITCH

FIELD OF THE INVENTION

This invention relates to a thermoswitch adapted for the temperature detection in a coolant compressor used mainly in an air conditioner for automobiles.

BACKGROUND OF THE INVENTION

A coolant compressor used in an air conditioner for an automobile is provided as an attachment to the automobile engine and, in use, is placed under harsh conditions in terms of vibration, heat and water. Accordingly, the thermoswitch provided to such coolant compressor for the prevention of overheating is also exposed to the same conditions as said compressor.

A typical example of the conventional thermoswitches of this type is disclosed in Japanese Utility Model Application Laid-Open No. 150245/83. In this example, electrode terminals 16*a*, 16*b* are secured to a sealing plate 17 and also project out through a resin layer 25, so that water tends to adhere to such terminals and also gaps might be produced due to vibrations transmitted to the terminals through lead wires, not shown, or for other causes to allow intrusion of water into the inside mechanism along electrode terminals 16*a*, 16*b* to wet the electrode plates and/or other elements, causing issuance of erroneous signals. Further, this conventional device had the problem of possible breakage of lead wires due to vibrations or other causes, though no mention is made of lead wires in said application.

SUMMARY OF THE INVENTION

A first object of the present invention, therefore, is to provide a thermoswitch which is not adversely affected by water.

A second object of the invention is to provide a thermoswitch protected from the breakage of lead wires.

In order to attain the first object, the present invention provides a thermoswitch of a type in which two fixed terminals are provided to a base disposed in a bottomed housing and a movable contact mechanism is provided between said two fixed elements, said movable contact mechanism being designed to be connected or disconnected by the displacement of a thermosensitive member such as bimetal, wherein the end of said housing is crimped with an O-ring interposed between said housing and base, and the basal portions of said fixed terminals extending from the base are solidified with a first resin while the recessed portion constituted by said housing and base is solidified with a second resin, and further the ends of heat-shrinkable tubes shrouding said lead wires are embedded in said resin.

Thus, the fixed terminals are covered with a second resin and don't project out, and also their basal portions are solidified with a first resin. In this way, there are formed a first and a second resin layer around the fixed terminals to keep the fixed terminal free of contact with of water, thus enabling the attainment of said first object.

In order to accomplish the second object, the present invention further incorporates the idea of sheathing the lead wires connected to said fixed terminals with a heat-shrinkable tube.

According to the present device, the lead wires are each sheathed tightly in a heat-shrinkable tube and therefore greatly improved in resistance to vibrations to realize said second object of the invention.

DETAILED DESCRIPTION OF THE INVENTION

Figure 1:
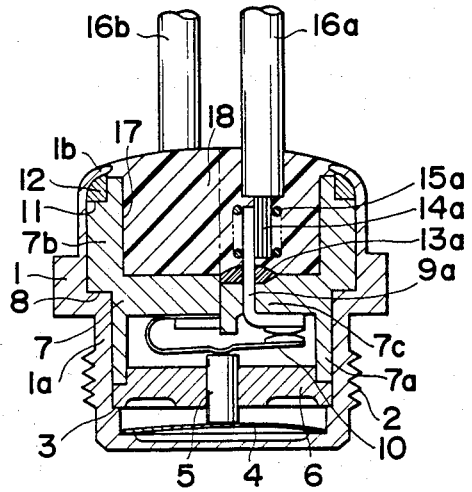
FIG. 1 is a sectional view of an embodiment of the present invention.
Figure 2:
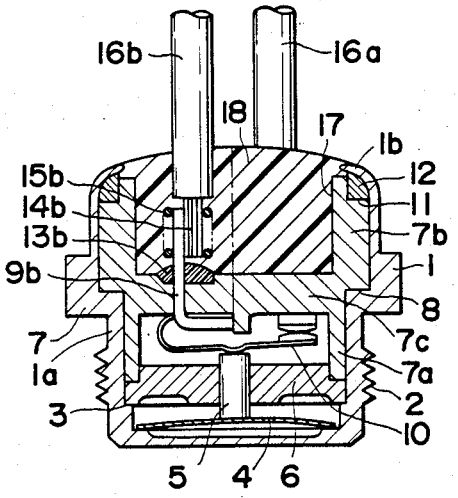
FIG. 2 is a sectional view similar to FIG. 1 but taken along a different vertical section.

The present invention will be described below by way of an embodiment thereof with reference to the accompanying drawings.

Referring to the drawings illustrating an embodiment of this invention, there is provided a bottomed housing 1 made of a metal material such as aluminum or brass and having on its outside a thread 2 for engagement with another member (such as a coolant compressor).

A bimetal disc 4 serving as a temperature-sensing member is disposed in said housing 1, and a plunger 5, described below, is provided in attacment to the central part of said bimetal disc 4.

Plunger 5 is displaced vertically in accordance with the temperature-induced reversal movement of said bimetal disc 4 while guided by a guide member 6 provided in engagement with a stepped portion 3 of an erect wall 1*a*, and such displacement is conveyed to a movable contact 10 described below.

Also disposed in said housing 1 is a base 7 which is H-shaped in section and so arranged that it fits with a stepped portion 8 of the erect wall 1*a*, with the lower end 7*a* of said base 7 pressing down said guide member 6. It will be seen that two fixed terminals 9*a*, 9*b* are provided to the transverse portion 7*c* of said base 7, and the movable contact 10 is disposed across said both fixed terminals 9*a*, 9*b*, said movable contact 10 being secured to the fixed terminal 9*b*. This arrangement plus said plunger 5 attached to said movable contact 10 constitutes a movable contact mechanism, and thus the movable contact 10 is connected or disconnected in accordance with he displacement of said plunger 5.

The upper end 7*b* of the base 7 is partly cut out and an O-ring 12 is disposed in this cut-out portion 11. Further, the open end 1*b* of said housing 1 is crimped or bent inwardly to compress said O-ring 12, thereby effecting a seal between said base 7 and housing 1.

The basal portions of said fixed terminals 9*a*, 9*b* provided to the base 7 are solidified with a first cold-setting resin 13*a*, 13*b*, and the end of each said terminal is connected to a lead wire 14*a* (14*b*) which is set in position by a spring 15*a* (15*b*) and then secured by soldering. Each of said lead wires 14*a*, 14*b* is sheathed wit a heat-shrinkable tube 16*a* (16*b*).

Each heat-shrinkable tube 16*a*, 16*b* is a commercial product, and each lead wire 14*a*, 14*b* is closely sheathed therein so that it is prevented from being broken by vibration.

The recess 17 defined by said housing 1 and base 7 is filled with a second thermosetting resin 18 which envelopes the connected portions of said fixed terminals 9*a*, 9*b* and lead wires 14*a*, 14*b* and in which the ends of the heat-shrinkable tubes 16*a*, 16*b* sheathing the lead wires 14*a*, 14*b* are also embedded. Thus, any water flowing down along the lead wires is confined in the second resin 18, so that water is prevented from entering through the lead wires. Even if water should have entered therethrough, further penetration of water is prevented by the first resin 13*a*, 13*b*.

What is claimed is:

1. A thermoswitch, comprising:

a bottomed housing;

a base disposed in said housing, said housing and said base defining a recess therein;

a first terminal and a second terminal, fixed in said base, said first and second terminals having basal portions projecting from said base into said recess;

means in said housing for alternatively electrically connecting and disconnecting said first terminal to and from said second terminal, said electrically connecting means including a movable contact and a thermosensitive member movable in response to temperature change to move said movable contact between a first position in which said first and second terminals are electrically connected through said movable contact and a second position in which said first and second terminals are electrically disconnected;

means, including an O-ring between said housing and said base, for sealing said thermoswitch against water flow between said housing and said base, said housing having a portion crimped over said O-ring, a cold setting resin in said housing solidifying said basal portions;

lead wires connected to said basal portions of said first and second terminals in said recess;

heat-shrinkable tubes sheathing said lead wires in said recess; and a thermosetting resin filling said recess so as to embed said heat-shrinkable tubes therein.

* * * * *